United States Patent [19]

Gilbert

[11] Patent Number: 4,568,399

[45] Date of Patent: Feb. 4, 1986

[54] PROPELLANT COMPOSITIONS

[75] Inventor: Everett E. Gilbert, Morristown, N.J.

[73] Assignee: The United States of America as represented by the Secretary of the Army, Washington, D.C.

[21] Appl. No.: 715,221

[22] Filed: Mar. 22, 1985

[51] Int. Cl.[4] ..... C06B 35/00

[52] U.S. Cl. ..... 149/35; 149/88; 149/94; 149/96; 149/109.6; 536/35; 536/56; 536/101

[58] Field of Search ..... 536/35, 56, 101; 149/35, 88, 94, 96, 109.6

[56] References Cited

U.S. PATENT DOCUMENTS

| | | | |
|---|---|---|---|
| 3,808,061 | 4/1974 | Pierce | 149/35 X |
| 4,195,174 | 3/1980 | Lemieux et al. | 536/53 X |
| 4,390,380 | 6/1983 | Camp | 149/35 X |

*Primary Examiner*—Stephen J. Lechert, Jr.

*Attorney, Agent, or Firm*—Anthony T. Lane; Robert P. Gibson; Edward F. Costigan

[57] ABSTRACT

An azidonitrate energetic composition i.e. cellulose azidonitrate and a process of making the same from nitrocellulose and sodium or lithium azide.

15 Claims, No Drawings

PROPELLANT COMPOSITIONS

GOVERNMENTAL INTEREST

The invention described herein may be manufactured, used and licensed by or for the Government for Governmental purposes without the payment to me of any royalties thereon.

FIELD OF THE INVENTION

This invention relates to azidonitrate propellant compositions.

More particularly, this invention relates to novel energetic compositions resulting from the reaction of nitrocellulose with sodium or lithium azide.

BACKGROUND OF THE INVENTION

The high reactivity of the azide group has prompted studies of the preparation of polymeric azides, since this moiety can be subsequently be converted with ease to several other types of substituent groups. The materials described herein are of special interest because of their ease of preparation from low-cost cellulose. The approach has been used to prepare other organic azides, but has not been employed to introduce the azide group into nitrocellulose for an improved propellant composition.

SUMMARY OF INVENTION

It is therefore an object of this invention to provide an improved azidonitrate energetic composition and a method of making the same.

Another object is to provide cellulose azidonitrate and a method of making the same.

A further object is to provide an improved energetic azidonitrate as the reaction product of nitrocellulose and sodium or lithium azide.

Other objects and many of the attendant advantages of this invention will become more clearly understood from a reading of the following detailed examples wherein:

EXAMPLE 1

0.7 g of nitrocellulose having a nitrogen content of 4.9 percent was mixed with stirring with 0.5 g of sodium azide in 25 ml of dimethyl sulfoxide for 66 hours at 85° C.

The reaction mixture was cooled, poured into water, yielding a fine, gelatinous precipitate. The latter was filtered out of the reaction mixture and dried. The yield was 0.35 g. The product was ground to a free-flowing tan powder and analysis showed 10.4 percent nitrogen.

The infrared spectrum indicated the presence of azide and nitrate groups.

The product gave a positive "match test". It flashed upon heating on a spatula held over a low Bunsen flame.

EXAMPLE 2

In accordance to the procedure of Example 1, 0.55 g of nitrocellulose having 8.4 percent nitrogen, 0.6 g of sodium azide, and 25 ml of dimethyl sulfoxide were heated with stirring a 75° C.

The yield of product was 0.2 g.

Analysis of the product showed the presence of 19.4 percent nitrogen.

The IR spectrum also indicated the presence of azide groups and nitrate groups in the product.

The product slowly darkened over the temperature range between 200° to 220° C. in a melting point capillary which indicated good thermal stability.

The product also flashed cleanly in a positive match test.

EXAMPLE 3

Following the procedure of Example 1 1.0 g of nitrocellulose having a nitrogen content of 12.6 percent, 5.0 g of sodium azide, and 25 ml of ethylene glycol were heated with stirring for 21 hours at 85° C.

The yield produced amounted to 0.3 g.

Peaks indicating azide and nitrate groups in the product were noted in the IR spectrum.

EXAMPLE 4

1.0 g of nitrocellulose having a 12.6 percent nitrogen content, 1.0 g of sodium azide, and 25 ml of dimethyl sulfoxide were stirred at room temperature for 40 hours. The procedure followed was as stated in Example 1.

0.4 g of the product was recovered having a nitrogen content of 15.5 percent.

The product gave a positive match test. The IR spectrum showed peaks for the azide groups and nitrate groups in the product.

The product slowly darkened above 200° C. in a capillary melting point tube.

EXAMPLE 5

The procedure of Example 1 was followed wherein 1.0 g of nitrocellulose have a nitrogen content of 12.6 percent, 1.0 g of lithium azide, and 25 ml of dimethylformamide were stirred together for 48 hours at room temperature.

The mixture was poured into water and yielded a gelatinous precipitate which was coagulated by adding a small amount of hydrochloric acid.

Product yield amounted to 0.5 g.

The product indicated the presence of azide groups and nitrate groups in the IR spectrum.

The product also gave a positive match test and blackened above 200° C.

EXAMPLE 6

1.0 g nitrocellulose (12.6 percent nitrogen), 1.0 g sodium azide, and 25 ml of ethylene glycol monethylether were stirred for 48 hours at 60° C.

The product was worked up in accordance to the aforementioned procedure and yielded 0.25 g.

The IR spectrum of the product showed azide and nitrate groups.

EXAMPLE 7

1.0 g of nitrocellulose having a nitrogen content of 6.0 percent, 1.0 g sodium azide, and 25 ml of dimethyl sulfoxide were mixed for 48 hours at 75° C. The reaction product was poured into 200 ml of water, and the mixture was filtered.

The solid product was boiled twice with water and filtered each time to remove impurities.

The yield amounted to 0.7 g.

The IR spectrum indicated the presence of azide groups and nitrate groups in the product.

The final product gave a positive match test and decomposed at 210° C.

EXAMPLE 8

The procedure of Example 7 was repeated with nitrocellulose having a nitrogen content of 8.2 percent. The product yield was 0.3 g. The properties of the product were similar to those described in Example 7.

EXAMPLE 9

The procedures of Example 7 were followed with the nitrocellulose having a nitrogen content of 8.5 percent.

Product yield amounted to 0.4 g.

The properties of the product were similar to those of the product of Example 7.

Note: The foregoing procedure produced a product which was water-insoluble in all of the working examples. The procedure followed in the examples which are hereafter set forth disclose the preparation of a water-soluble product.

EXAMPLE 10

1.0 g of nitrocellulose having 12.5 percent nitrogen was dissolved in 100 ml of warm tetrahydrofuran, and a solution of 1.0 g of sodium azide in 5 ml of water was added thereto.

The above mixture was refluxed with stirring for 48 hours at 65° to 70° C.

The brown solution was decanted from the solid material, and the latter was dried.

The product yield amounted to 0.75 g of a brown solid which was completely water-soluble.

The product gave a positive match test, and the IR spectrum indicated the presence of azide and nitrate groups in the product.

EXAMPLE 11

1.0 g of nitrocellulose having equal quantities of two batches having 12.2 percent and 13.5 percent nitrogen respectively were mixed with 0.5 g of sodium azide and 25 ml of dimethyl sulfoxide.

The above mixture was stirred at room temperature for 113 hours.

The resulting mixture was poured into water without the appearance of any solid.

EXAMPLE 12

In accordance with the procedure of Example 11, a comparative experiment was carried out without the addition of sodium azide.

The result was that all of the nitrocellulose was recovered unchanged.

In reference to Table 1, set forth below, the products tested were prepared in accordance with the procedure heretofore described. The infrared spectra of the products, as shown in Table 1, indicated that they contained both azide groups and nitrate groups. The elemental analyses as shown indicates that the products have the same general structure as the starting nitrates and comprise anhydroglucose (AHG) units containing two types of groups i.e. the azide and nitrate groups. The azide group replaces the nitrate group during reaction. The approximate degree of replacement, also based on the elemental analysis, is as shown in the table. The weight yield of products varying from 25 to 70 percent shows the degradation to water-soluble materials always occurs to a greater or lesser extent.

TABLE 1

| Composition Data | | | | | | | | | | |
|---|---|---|---|---|---|---|---|---|---|---|
| Starting Nitrocellulose | | Elemental Analysis (1) | | | | | | Product Composition (2) | | Percent Replacement (3) |
| | $NO_2$ groups | C | | H | | N | | | | |
| % N | per AHG | Calc. | Found | Calc. | Found | Calc. | Found | Nitrate | Azide | |
| 4.9 | 0.66 | 38.8 | 38.8 | 5.1 | 5.5 | 10.1 | 10.4 | 0.33 | 0.33 | 50 |
| 6.0 | 0.83 | 38.0 | 37.2 | 4.8 | 5.3 | 13.5 | 13.5 | 0.33 | 0.50 | 60 |
| 8.2 | 1.3 | 34.5 | 34.7 | 4.2 | 4.6 | 17.9 | 19.1 | 0.66 | 0.66 | 50 |
| 8.4 | 1.3 | 33.4 | 33.6 | 4.2 | 4.1 | 13.0 | 13.6 | 1.00 | 0.33 | 25 |
| 8.4 | 1.3 | 34.5 | 34.8 | 4.2 | 4.5 | 17.9 | 18.9 | 0.66 | 0.66 | 50 |
| 8.5 | 1.3 | 35.6 | 35.8 | 4.3 | 4.4 | 23.1 | 22.5 | 0.33 | 1.00 | 75 |

(1) The calculated values are for the compositions given in the product composition column.
(2) Approximate number of groups per AHG unit.
(3) Replacement of nitrate groups by azide groups.

In all cases where a solid was recovered from the foregoing procedure, set forth in the example, it passed the match-test. This indicated that the product obtained was a highly energetic composition which could be utilized as a propellant. In some cases, the results indicated that the solid had good thermal stability. Also, due to the fact that nitrocellulose is of relatively low cost, the azidonitrate product would be relatively cost effective as a propellant. Due to the amount of propellant utilized by the military, this would result in relatively tremendous savings by the Government.

The foregoing disclosure is merely illustrative of the principles of this invention and are not to be interpreted in a limiting sense. I wish it to be understood that I do not desire to be limited to the exact details of the procedure set forth in the examples described, obvious modifications will occur to a person skilled in the art.

I claim:

1. Cellulose azidonitrate.

2. An improved energetic azidonitrate composition being the reaction product of nitrocellulose and sodium azide.

3. A process of making cellulose azidonitrate consisting of mixing between 0.5 to 1.0 gms of nitrocellulose and between 0.5 to 5.0 gms of sodium azide in a solvent at room temperature to 85° C. for 21 to 66 hours.

4. The process of claim 3 wherein, in proportion, 0.7 g of nitrocellulose having 4.9 percent nitrogen and 0.5 g of sodium azide were mixed in 25 ml of dimethyl sulfoxide for 66 hours at 85° C.

5. The process of claim 3 wherein, in proportion, 0.55 g of nitrocellulose having 8.4 percent nitrogen and 0.6 g of sodium azide were mixed in 25 ml. of dimethyl sulfoxide for 48 hours at 75° C.

6. The process of claim 3 wherein, in proportion, 1.0 g of nitrocellulose having 12.6 percent nitrogen and 5.0 g of sodium azide were mixed in 25 ml. of ethylene glycol for 21 hours at 85° C.

7. The process of claim 3 wherein, in proportion, 1.0 g of nitrocellulose having 12.6 percent nitrogen and 1.0 g of sodium azide were mixed in 25 ml. of dimethyl sulfoxide for 40 hours at room temperature.

8. The process of claim 3 wherein, in proportion, 1.0 g of nitrocellulose havin 12.6 percent nitrogen and 1.0 g of lithium azide were mixed in 25 ml. of dimethylformamide for 48 hours at room temperature.

9. The process of claim 3 wherein, in proportion, 1.0 g of nitrocellulose having 12.6 percent nitrogen and 1.0 g of sodium azide were mixed in 25 ml. of ethylene glycol monoethyl ether for 48 hours at 60° C.

10. The process of claim 3 wherein, in proportion, 1.0 g of nitrocellulose having 6.0 percent nitrogen and 1.0 g of sodium azide were mixed in 25 ml. of dimethyl sulfoxide for 48 hours at 75° C.

11. The process of claim 3 wherein, in proportion, 1.0 g of nitrocellulose having 8.2 percent nitrogen and 1.0 g of sodium nitrate were mixed in 25 ml. of dimethyl sulfoxide for 48 hours at 75° C.

12. The process of claim 3 wherein, in proportion, 1.0 g of nitrocellulose having 8.5 percent nitrogen wre mixed in 25 ml. of dimethyl sulfoxide for 48 hours at 75° C.

13. The process of claim 3 wherein, in proportion, 1.0 g of nitrocellulose having 12.5 percent nitrogen and 1.0 g of sodium nitrate were mixed in 5 ml. of water for 48 hours at 65° C. to 75° C.

14. The process of claim 3 wherein, the proportion, 1.0 g of nitrocellulose having equal quantities of 12.2 and 13.5 percent nitrogen and 0.5 g of sodium azide were mixed in dimethyl sulfoxide for 113 hours at room temperature.

15. A process of making cellulose azidonitrate consisting, in proportion, of mixing 1.0 g of nitrocellulose having 12.5 percent nitrogen dissolved in 100 ml of warm tetrahydrofuran with 1.0 g of sodium azide dissolved in 5 ml of water for 48 hours at a temperature of 65° to 70° C.

* * * * *

UNITED STATES PATENT AND TRADEMARK OFFICE

CERTIFICATE OF CORRECTION

PATENT NO. : 4,568,399

DATED : February 4, 1986

INVENTOR(S) : Everett E. Gilbert

It is certified that error appears in the above-identified patent and that said Letters Patent is hereby corrected as shown below:

Claim 11, Col 5, line 19, delete "sodium nitrate" and substitute therefor --sodium azide--;

Claim 13, Col. 6, Line 7, delete "Sodium Nitrate: and substitute therefor --sodium azide--.

Signed and Sealed this

Tenth Day of February, 1987

*Attest:*

DONALD J. QUIGG

*Attesting Officer*

*Commissioner of Patents and Trademarks*